United States Patent [19]

Sarica

[11] Patent Number: 4,726,387

[45] Date of Patent: Feb. 23, 1988

[54] COSMETIC CASE AND APPLICATOR

[75] Inventor: Dominick A. Sarica, Kenilworth, N.J.

[73] Assignee: Pfizer Inc., New York, N.Y.

[21] Appl. No.: 911,693

[22] Filed: Sep. 26, 1986

[51] Int. Cl.[4] ..... A45D 44/18

[52] U.S. Cl. ..... 132/85; 132/79 A; 132/82 G; 132/83 R

[58] Field of Search ..... 132/79 A, 79 F, 82 C, 132/82 R, 83 R, 83 A, 82 H, 82 A, 85, 79 G, 82 G; 206/37, 38, 235; 401/121

[56] References Cited

U.S. PATENT DOCUMENTS

| | | | |
|---|---|---|---|
| D. 281,731 | 12/1985 | Phu | D28/83 |
| 817,694 | 4/1906 | Chaquette | 132/82 H |
| 2,180,404 | 11/1939 | Eastley | 132/79 A |
| 3,480,371 | 11/1969 | Lee | 401/121 |
| 4,337,859 | 7/1982 | Murphy et al. | 206/37 |
| 4,421,127 | 12/1985 | Goer | 132/83 R |
| 4,555,020 | 11/1985 | Campello et al. | 206/235 |
| 4,579,133 | 4/1986 | Seidler | 132/85 |

FOREIGN PATENT DOCUMENTS

| | | | |
|---|---|---|---|
| 953305 | 12/1949 | France | 132/85 |
| 595155 | 11/1947 | United Kingdom | 132/82 R |

*Primary Examiner*—Gene Mancene
*Assistant Examiner*—J. Hakomaki
*Attorney, Agent, or Firm*—Peter C. Richardson; Lawrence C. Akers; Mark Dryer

[57] ABSTRACT

A cosmetic case and applicator are disclosed in which the handle of the applicator extends partially outside the case and serves to open the case when turned.

6 Claims, 1 Drawing Figure

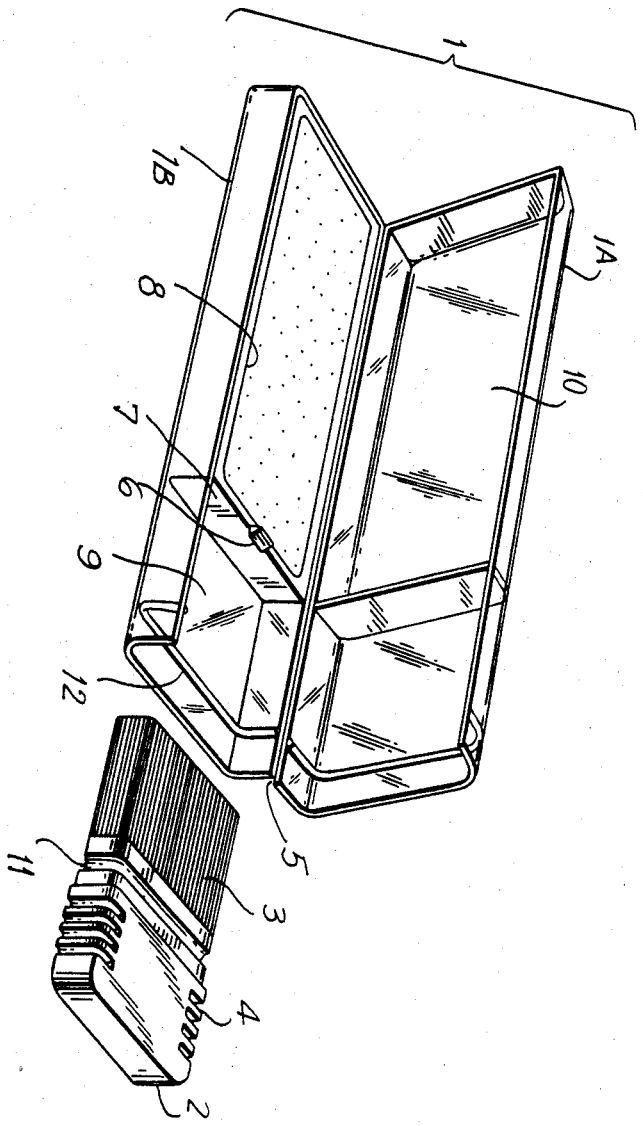
1
1A
10
5
12
11
3
4
2
1B
8
7
6
9

COSMETIC CASE AND APPLICATOR

BACKGROUND OF THE INVENTION

The present invention is in the field of cosmetic packaging. In particular it is concerned with a portable cosmetic case having an applicator included.

The prior art contains several such cases. For example, U.S. Pat. No. Des. 281,731 shows a cosmetic case having a drawer and having a special niche for holding an applicator brush.

U.S. Pat. No. Des. 4,337,859 shows a case containing caked powder which has a special shallow recess to receive an applicaton.

U.S. Pat. No. Des. 4,421,127 shows a multicompartmetal compact case with interchangeable cosmetic containers such as lipsticks and compacted powder and having a painting brush inserted in the case.

U.S. Pat. No. Des. 4,555,020 shows a compact which holds numerous articles in frictionally engaged side compartments. The handles of the side compartments are specially shaped to prevent rotational movement.

Finally, U.S. Pat. No. Des. 4,579,133 shows a cosmetic compact with an extendible applicator.

SUMMARY OF THE INVENTION

The present invention comprises, in combination, a container and an applicator consisting of a brush or a sponge and a handle therefor, the container being substantially rectangular and comprising top and bottom congruent components, the components being hinged along one long side and provided with a friction catch on the inside of the side opposite the hinged side, the container being divided into a pair of compartments by a wall transverse to the long side, the first compartment being designed to contain a substance to be dispersed by the brush or sponge, the second compartment being open at the associated short side of the container, adjacent to the hinged side, the applicator being substantially rectangular and dimensioned to fit snugly within the second compartment with the brush or sponge confined completely within the compartment and the handle being partially so confined with a portion extending from the open side, whereby twisting the extending handle portion will release the friction catch and open the container.

The combination wherein the container has a mirrored surface is preferred as is the combination wherein the substance is a personal care product such as blusher or compressed powder. The combination wherein the applicator handle has an indentation and the second compartment has a raised ridge designed to engage the indentation is also preferred.

DESCRIPTION OF THE DRAWING

The drawing illustrates the best mode presently known for carrying out the present invention.

Figure —An exploded view of the cosmetic case and applicator.

DETAILED DESCRIPTION OF THE INVENTION

The Figure illustrates a cosmetic case and applicator in accordance with the present invention. All essential features are shown as well as certain optional ones.

The rectangular container 1 includes a top component 1A and a bottom component 1B, which are hinged 5 along one long side. The container is divided into a first compartment 8 and a second compartment 9 by a transverse wall 7. The transverse wall is provided with a friction catch 6 which holds the top and bottom components together in the closed position. The first compartment is designed to contain material to be dispersed such a personal care products including cosmetics. The second compartment has one open side adjacent to the hinged side. An optional feature which is illustrated is the mirrored surface 10 inside the first compartment.

The applicator 2 is substantially rectangular and is designed to fit into the second compartment 9 with the brush or sponge end 3 contained entirely within the compartment and the handle 4 extending through the open side of the compartment. Twisting on the extending handle will exert sufficient pressure to release the friction catch and open the container.

Two other optional features which are illustrated are the raised ridge 12 in the second compartment designed to fit into the indentation 11 in the applicator handle. Although a brush is illustrated, a person skilled in the field of cosmetic packaging will appreciate that other delivery surfaces such as a sponge or puff can be employed with equal success and the choice will depend on the material to be dispersed.

A container of this type can be usefully employed to disperse a variety of personal care products such as shoe polish and all types of cosmetics. In particular, products such as blusher, compressed powder and eye shadow are especially suited for such a container and applicator.

The foregoing is illustrative in nature and is not intended to limit the scope of the appended claims.

I claim:

1. A combination container and applicator in which said container is substantially rectangular and comprises a top component and a bottom component, said top and bottom components being hinged along one side and being lockingly engaged to each other through releasable latch means, said container being divided into a pair of compartments by a wall transverse to said hinged side, the first said compartment being defined by walls on each of its sides to form a closed compartment for containing a substance to be dispensed by said applicator, the second said compartment being defined by three walls and being open at the end opposite said transverse dividing wall, said applicator being substantially rectangular and dimensioned to fit snugly within said second compartment and having a handle with a distal end and a proximal end, the distal end of said handle being integrally attached to said applicator and having engaging means which lockingly engage with cooperating engaging means associated with said second compartment and the proximal end of said handle extending through the open end of said second compartment, whereby turning said extending proximal end of said handle relative to said second compartment will release said latch means and open said container.

2. The combination of claim 1 wherein the inside of said top component of said container has a mirrored surface.

3. The combination of claim 1 wherein said substance is a personal care product.

4. The combination of claim 1 wherein the engaging means of said handle comprises an indentation in the distal end of the handle and the cooperating engaging means associated with said second compartment comprises a raised ridge designed to engage said indentation.

5. The combination of claim 1 wherein said applicator is a brush.

6. The combination of claim 1 wherein said applicator is a sponge.

* * * * *